US010167158B2

(12) United States Patent
Nishimura

(10) Patent No.: US 10,167,158 B2
(45) Date of Patent: Jan. 1, 2019

(54) SLITTER DEVICE

(71) Applicant: TSUDAKOMA KOGYO KABUSHIKI KAISHA, Ishikawa-ken (JP)

(72) Inventor: Isao Nishimura, Ishikawa (JP)

(73) Assignee: TSUDAKOMA KOGYO KABUSHIKI KAISHA, Kanazawa-shi, Ishikawa-ken (JP)

( * ) Notice: Subject to any disclaimer, the term of this patent is extended or adjusted under 35 U.S.C. 154(b) by 0 days.

(21) Appl. No.: 15/805,570

(22) Filed: Nov. 7, 2017

(65) Prior Publication Data

US 2018/0127227 A1 May 10, 2018

(30) Foreign Application Priority Data

Nov. 8, 2016 (JP) ..... 2016-218212

(51) Int. Cl.
*D03J 1/08* (2006.01)
*B65H 18/10* (2006.01)
(Continued)

(52) U.S. Cl.
CPC ..... *B65H 23/1806* (2013.01); *B65H 18/103* (2013.01); *B65H 20/02* (2013.01);
(Continued)

(58) Field of Classification Search
CPC ..... B65H 23/1806; B65H 23/1888; B65H 23/005; B65H 18/103; B65H 20/02;
(Continued)

(56) References Cited

U.S. PATENT DOCUMENTS 2,073,776 A * 3/1937 Berg ..... B23D 19/06 242/415.1
3,380,686 A * 4/1968 Gaudin ..... B21C 47/006 242/417
3,591,101 A * 7/1971 Gallet ..... B26D 1/035 242/415.1
3,638,873 A * 2/1972 Cole ..... B65H 59/384 242/413.5
(Continued)

FOREIGN PATENT DOCUMENTS

JP S57-203641 A 12/1982
JP 2001-063883 A 3/2001
WO WO 2013/163638 A1 10/2013

OTHER PUBLICATIONS

Apr. 4, 2018, European Search Report issued for related EP application No. 17200375.8.

*Primary Examiner* — William A. Rivera
(74) *Attorney, Agent, or Firm* — Paratus Law Group, PLLC

(57) ABSTRACT

A slitter device includes a first tension detecting unit for obtaining a raw-cloth tension value which is a tension value of a sheet material fed out from a let-off mechanism, a second tension detecting unit for obtaining a divided material tension value which is the sum of the tension values of each of divided sheet materials, and a drive control device which includes a comparator to which the first tension detecting unit and the second tension detecting unit are connected, and which compares the raw-cloth tension value and the divided material tension value with each other; and a drive controller which controls an operating state of a roll driving motor such that the raw-cloth tension value and the divided material tension value coincide or substantially coincide with each other based on the comparison result of the comparator.

1 Claim, 4 Drawing Sheets

(51) Int. Cl.

| | |
|---|---|
| ***B65H 20/02*** | (2006.01) |
| ***B65H 23/00*** | (2006.01) |
| ***B65H 23/04*** | (2006.01) |
| ***B65H 23/18*** | (2006.01) |
| ***B65H 35/02*** | (2006.01) |
| ***B65H 23/188*** | (2006.01) |

(52) U.S. Cl.
CPC ..... *B65H 23/005* (2013.01); *B65H 23/044* (2013.01); *B65H 23/1888* (2013.01); *B65H 35/02* (2013.01); *D03J 1/08* (2013.01); *B65H 2301/4148* (2013.01); *B65H 2301/515323* (2013.01); *B65H 2557/20* (2013.01); *B65H 2701/174* (2013.01)

(58) Field of Classification Search
CPC .. B65H 35/02; B65H 23/044; B65H 2557/20; B65H 2301/4148; B65H 2701/174; B65H 2301/515323; D03J 1/08
See application file for complete search history.

(56) References Cited

U.S. PATENT DOCUMENTS

| | | | | | |
|---|---|---|---|---|---|
| 3,750,973 | A * | 8/1973 | Walters | B65H 18/145 | 242/418 |
| 4,293,101 | A * | 10/1981 | Dunaevsky | B65H 18/103 | 242/413.4 |
| 4,480,799 | A * | 11/1984 | Yano | H01F 41/094 | 242/412 |
| 4,729,520 | A | 3/1988 | Kataoka | | |
| 5,062,582 | A * | 11/1991 | Harmon | B26D 7/1827 | 242/412.2 |
| 5,474,248 | A * | 12/1995 | Bradshaw | B65H 23/063 | 242/421.8 |
| 6,085,956 | A | 7/2000 | Sainio et al. | | |
| 8,940,123 | B2 * | 1/2015 | Hou | B65H 18/08 | 156/259 |
| 2001/0045486 | A1 * | 11/2001 | Zeller | D02H 13/24 | 242/419.1 |

* cited by examiner

SLITTER DEVICE

CROSS-REFERENCE TO RELATED APPLICATION

This application claims priority from Japanese Patent Application No. 2016-218212 filed on Nov. 8, 2016, the entire contents of which are incorporated herein by reference.

BACKGROUND OF THE INVENTION

1. Field of the Invention

The present invention relates to a slitter device that includes a let-off mechanism having a let-off driving unit on which a raw-cloth roller formed by winding up an elongated sheet material in a roll shape is mounted, and which has a let-off driving motor as a driving source for rotationally driving the raw-cloth roller, a cutter device for dividing the sheet material fed out from the let-off mechanism in a width direction of the sheet material to form a plurality of divided sheet materials, having a plurality of disk-shaped rotary blades provided according to the number of divisions of the sheet material, and having a support roll to which the rotary blade is pressed and around which the sheet material is wound, a take-up mechanism having a winding shaft on which a plurality of take-up reels for winding up each of the divided sheet materials are supported, and having a take-up driving unit which has a take-up driving motor as a driving source for rotationally driving the winding shaft, and a drive control device for controlling the driving of the let-off driving unit and the take-up driving unit, which performs the drive control of one of the let-off driving unit and the take-up driving unit as a tension control and performs the drive control of the other as a speed control.

2. Description of the Related Art

In JP-A-2001-063883, a device (slitter device) that transports a sheet (sheet material) unwound (fed out) from a raw-cloth roller by a transport roll and slits (cuts and divides) the sheet in the transporting process to form a narrow sheet (divided sheet material) is disclosed. In the slitter device (hereinafter referred to as "device in the related art") disclosed in JP-A-2001-063883, each of the divided sheet materials is wound up on a winding shaft, one of feeding-out of the sheet material from the raw-cloth roller and winding-up of the divided sheet material with respect to the winding shaft is performed by a speed control, and the other is performed by a tension control.

In the device in the related art, a slit section is provided so as to interpose the sheet material with respect to the transport roll (more accurately, one of a plurality of transport rolls is provided). On the transport roll, the sheet material passing through the transport roll is cut by the slit section. In other words, the device in the related art has a roll (support roll) that supports the sheet material when the transport roll cuts the sheet material, and the support roll is configured to be rotationally driven. A cutter device is configured to include the support roll and the slit section.

In the device in the related art, a rotational speed of the support roll is controlled so that a peripheral speed of the support roll is a speed synchronized with a transport speed of the sheet material. Specifically, for example, in a case where the feeding-out from the raw-cloth roller is performed by the speed control and the winding-up is performed by the tension control, the control is performed in a manner of detecting a feeding speed of the raw-cloth roller as the transport speed and rotationally driving so that the peripheral speed is the same as the detected speed.

SUMMARY OF THE INVENTION

Meanwhile, a cutter in a cutter device for dividing (cutting) a sheet material has a plurality of disk-shaped rotary blades provided according to the number of divisions. In a case of a slitter device in which the cutter device is configured to cut the sheet material in cooperation with a support roll and the rotary blade around which the sheet material is wound when the rotary blade is pressed, it is necessary for the tension of the sheet material to be cut to the desired degree such that the cutting of the sheet material is appropriately performed.

Conversely, if the tension of the sheet material to be cut is not the desired degree, there arises a problem that, for example, cutting defect occurs and the quality of a divided sheet material after cutting is deteriorated. In particular, in a case where the sheet material processed in the slitter device is the prepreg sheet, the above-described problem that occurs due to the fact that the tension is not the desired degree appears remarkably. Incidentally, the prepreg sheet mentioned here is a prepreg sheet in which a prepreg as a reinforced fiber material formed by impregnating a plurality of reinforced fibers (carbon fiber, glass fiber, and the like) with a matrix resin is formed into a sheet shape.

On the other hand, in the device in the related art, the support roll rotationally drives by the control as described above so that the sheet material is transported without causing wrinkles, scratches, and the like on the sheet material. According to the control, in theory, the sheet material is transported at a constant transport speed and the tension thereof should be maintained to the extent corresponding to the tension control. However, in reality, since the transport speed changes, the degree of tension changes in accordance with the change in the transport speed, and the above-described problem occurs.

Specifically, in the slitter device, the transport speed of the sheet material actually changes even if the feeding speed is constant due to various factors acting on the sheet material during the transporting process. One of the factors is the transport resistance acting on the sheet material by engagement with the rotary blade in the cutter device. The transport resistance increases as the number of rotary blades in the cutter device increases (as the cutting width required decreases).

When the transport speed changes as described above, the feeding speed (amount of the sheet material fed from the raw-cloth roller) of the sheet material from a raw-cloth roller and the transport speed (amount of movement of the sheet material by the transport speed) in the transport route of the sheet material do not coincide with each other, so that the degree of tension of the sheet material changes as described above. As a result, there are cases in which the tension deviates from the desired degree at which the sheet material can be appropriately cut, which may cause the above-described problem.

As described above, in the control of the rotational driving of the support roll in JP-A-2001-063883 in which only the theoretical transport speed is considered, since the influence of the factors of the transport resistance as described above on the transport of the sheet material and the actual tension of the sheet material are not considered, it is impossible to sufficiently cope with cutting of the sheet material appropriately by the cutter device.

Therefore, it is an object of the invention to control a roll driving motor to rotationally drive the support roll in the slitter device as described above, so that the tension of the sheet material is maintained to a desired extent and cutting of sheet material by the cutter device is appropriately performed.

According to an aspect of the invention, there is provided a slitter device that includes a let-off mechanism having a let-off driving unit on which a raw-cloth roller formed by winding up an elongated sheet material in a roll shape is mounted, and which has a let-off driving motor as a driving source for rotationally driving the raw-cloth roller, a cutter device for dividing the sheet material fed out from the let-off mechanism in a width direction of the sheet material to form a plurality of divided sheet materials, having a plurality of disk-shaped rotary blades provided according to the number of divisions of the sheet material, and having a support roll to which the rotary blade is pressed and around which the sheet material is wound, a take-up mechanism having a winding shaft on which a plurality of take-up reels for winding up each of the divided sheet materials are supported, and having a take-up driving unit which has a take-up driving motor as a driving source for rotationally driving the winding shaft, and a drive control device for controlling the driving of the let-off driving unit and the take-up driving unit, which performs the drive control of one of the let-off driving unit and the take-up driving unit as a tension control and performs the drive control of the other as a speed control.

The slitter device further includes a roll driving motor that is connected to the support roll to rotationally drive the support roll, a first tension detecting unit for obtaining a raw-cloth tension value which is a tension value of the sheet material fed out from the let-off mechanism, and a second tension detecting unit for obtaining the divided material tension value which is the sum of the tension values of each of the divided sheet materials, in which the drive control device includes a comparator to which the first tension detecting unit and the second tension detecting unit are connected, and which compares the raw-cloth tension value and the divided material tension value with each other; and a drive controller which controls an operating state of the roll driving motor such that the raw-cloth tension value and the divided material tension value coincide or substantially coincide with each other based on the comparison result of the comparator.

According to the slitter device of the invention, the control of the roll driving motor for rotatably driving the support roll is not performed based on the transport speed of the sheet material as in the device in the related art described above, and refers directly to the tension of the sheet material affecting the cutting of the sheet material by the cutter device and is performed based on the tension. Therefore, the tension of the sheet material is maintained to the desired extent and the cutting of the sheet material by the cutter device is appropriately performed.

DESCRIPTION OF THE PREFERRED EMBODIMENTS

Hereinafter, an embodiment (example) of a slitter device according to the invention will be described. The example (present example) to be described below is an example in which feeding-out of a sheet material from a raw-cloth roller is performed by a speed control and winding-up of a divided sheet material with respect to a winding shaft is performed by a tension control. In the slitter device, a take-up mechanism is provided with two winding shafts, and the plurality of divided sheet materials formed by dividing (cutting) the sheet material are divided and wound up on the respective winding shafts.

Figure 1:
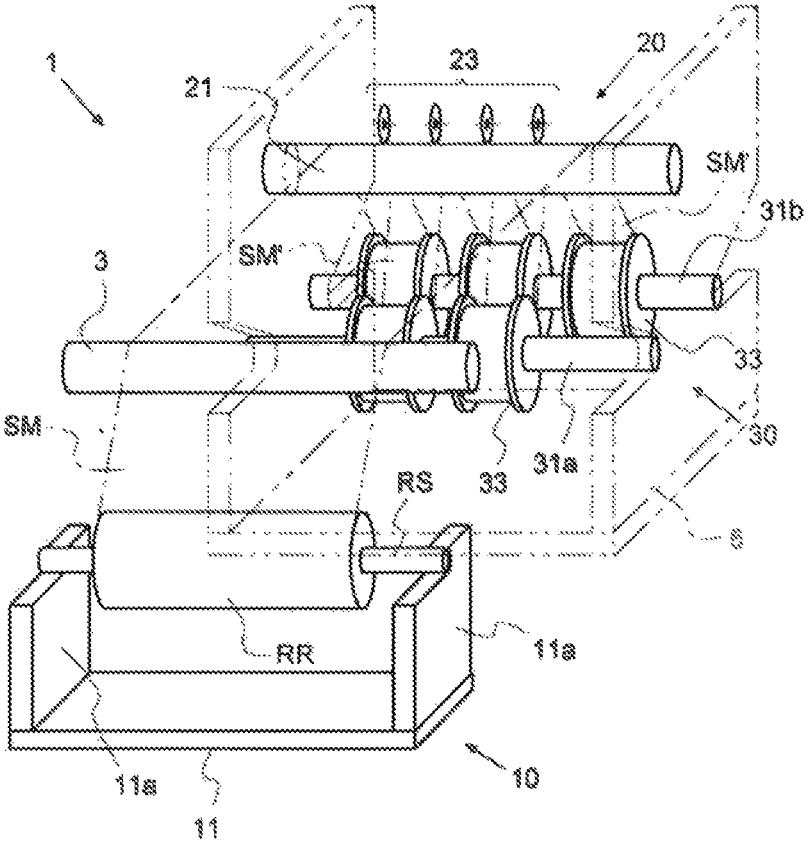
FIG. 1 is a perspective view illustrating an example of a portion to be a premise of a slitter device according to the invention.
Figure 2:
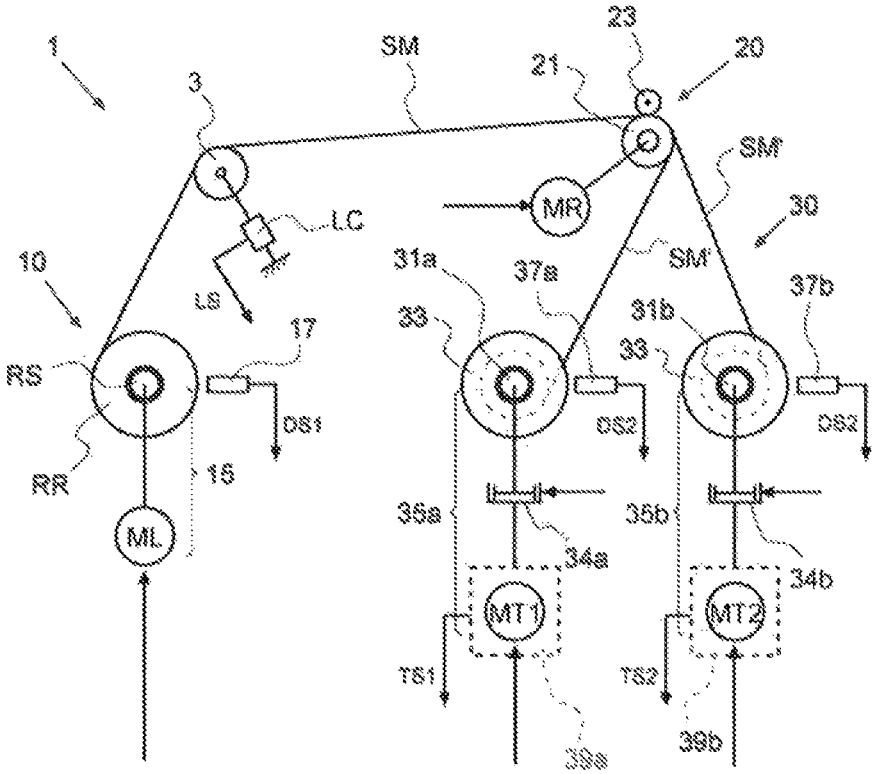
FIG. 2 is a side view schematically illustrating a device configuration in an embodiment of the slitter device according to the invention.

A slitter device 1 includes a let-off mechanism 10 on which a raw-cloth roller RR is mounted, a cutter device 20 for dividing a sheet material SM fed out from the raw-cloth roller RR in the width direction of the sheet material SM, and a take-up mechanism 30 for winding up a divided sheet material SM' formed by dividing the sheet material SM by the cutter device 20 (FIGS. 1 and 2).

Incidentally, as the sheet material SM which is divided by the slitter device 1 in this manner, for example, one example thereof is a prepreg sheet in which a prepreg as a reinforced fiber material formed by impregnating a plurality of reinforced fibers (carbon fiber, glass fiber, and the like) with a matrix resin is formed into a sheet shape. The raw-cloth roller RR is formed in a manner that such an elongated sheet material SM is wound up around a core shaft RS in a roll shape.

As illustrated in FIG. 1, the let-off mechanism 10 includes a support base 11 for supporting the core shaft RS of the raw-cloth roller RR. The support base 11 has a pair of support walls 11*a* and 11*a* spaced apart in the width direction of the slitter device 1, and supports the core shaft RS in a manner bridged over the support walls 11*a* and 11*a*. Although detailed description and drawing are omitted, the support base 11 is configured to rotatably support the core shaft RS at a predetermined position on the pair of support walls 11*a* and 11*a*.

The let-off mechanism 10 includes a let-off driving unit 15 including a let-off driving motor ML for rotationally driving the core shaft RS (raw-cloth roller RR) supported by the support base 11 as described above. The let-off driving motor L is provided in a manner supported by the support base 11, for example. In the example as illustrated in FIGS. 3A and 3B, the let-off driving motor ML is disposed such that the output shaft thereof is oriented in the width direction (axial direction of the core shaft RS), and the position of the axis of the output shaft coincides with the position of the axis of the core shaft RS as viewed in the width direction.

The let-off driving motor ML can rotationally drive the raw-cloth roller RR by connecting the output shaft thereof to one end of the core shaft RS via a known coupling mechanism (not illustrated, and hereinafter, simply referred to as "coupling mechanism") including a shaft coupling or the like. Accordingly, in the example, the let-off driving unit 15 that rotationally drives the raw-cloth roller RR is configured to include the let-off driving motor ML and the coupling mechanism. The sheet material SM is fed out from the raw-cloth roller RR by rotationally driving the raw-cloth roller RR by the let-off driving motor ML. The let-off driving unit may be configured to couple the let-off driving motor ML and the core shaft RS via a driving-force transmission mechanism such as a gear train or the like.

Furthermore, the let-off mechanism 10 includes a sensor 17 (let-off side winding diameter sensor) for detecting the winding diameter of the sheet material SM in the raw-cloth roller RR. The let-off side winding diameter sensor 17 outputs a signal WS1 (winding diameter detection signal) for obtaining the winding diameter of the raw-cloth roller RR, which is an output signal corresponding to the detected value toward a drive control device 40 described later.

Figure 3A:
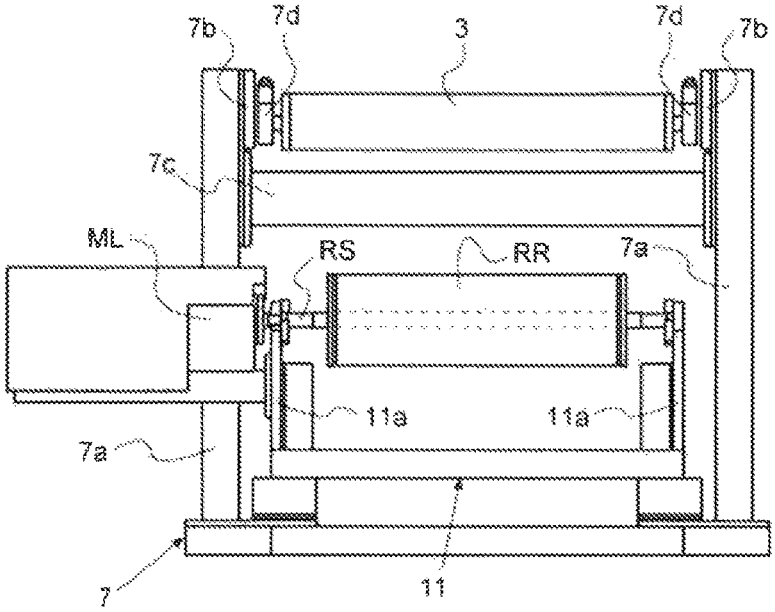
FIG. 3A is a front view and FIG. 3B is a partial cross-sectional side view illustrating a portion on a let-off side in the embodiment of the slitter device according to the invention.
Figure 3B:
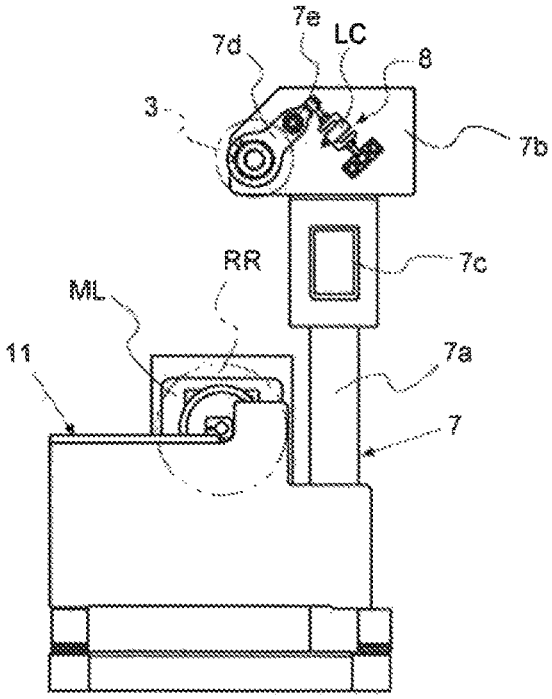

A guide roll 3 is provided above the let-off mechanism 10 as illustrated in FIGS. 3A and 3B. That is, the slitter device 1 includes the guide roll 3 provided above the let-off mechanism 10. The guide roll 3 is rotatably supported at both end portions thereof by a frame 7 on the let-offside in the slitter device 1. More specifically, the slitter device 1 is provided with the frame 7 on the let-off side. The frame 7 has a pair of columns 7*a* and 7*a* erected spaced apart in the width direction. Furthermore, brackets 7*b* are attached to the upper end of each of the columns 7*a*. The guide roll 3 is rotatably supported by the pair of brackets 7*b* and 7*b*. Incidentally, the support base 11 in the let-off mechanism 10 described above is provided on the frame 7. The pair of the columns 7*a* and 7*a* in the frame 7 of the let-offside are connected by a beam member 7*c*.

The sheet material SM fed out from the raw-cloth roller RR is guided to the cutter device 20 side through the guide roll 3. The cutter device 20 is provided at a position spaced backward with respect to the guide roll 3 in the front-rear direction, of the slitter device 1. Accordingly, the sheet material SM fed out upward (guide roll 3 side) from the raw-cloth roller RR is wound around the guide roll 3 and is turned toward the cutter device 20 located behind by the guide roll 3.

The cutter device 20 is provided with a support roll 21 disposed slightly above the guide roll 3 in the rear position. The sheet material SM guided to the side of the cutter device 20 is wound around the support roll 21 and is turned toward the take-up mechanism 30 located below the cutter device 20. Accordingly, the support roll 21 in the cutter device 20 functions as the guide roll guiding the sheet material SM.

The cutter device 20 is provided with a plurality (four in the illustrated example) of disk-shaped rotary blades 23 (so-called "score cutter", and hereinafter referred to as "score cutter") for dividing (cutting) the sheet material SM in the width direction. The plurality of score cutters 23 are disposed at equal intervals in the width direction on the support roll 21. The cutter device 20 is a pressing mechanism (not illustrated) fixedly provided in the slitter device 1, and is provided with a pressing mechanism for supporting each of the score cutters 23. Each of the score cutters 23 is in a pressed state against the support roll 21 by being urged toward the support roll 21 by the pressing mechanism.

As a result, the sheet material SM guided to the support roll 21 is cut by each of the score cutters 23 along with the passage between the support roll 21 and the score cutter 23, and is divided into a number (5 (dividing) in the illustrated example) corresponding to the number of the score cutter 23 in the width direction. Each of the divided sheet materials SM' formed by dividing the sheet material SM in this manner is guided to the take-up mechanism 30 located below the cutter device 20 as described above.

The take-up mechanism 30 is provided with the winding shaft which is rotationally driven to wind up the divided sheet material SM'. However, in the example, the take-up mechanism 30 is configured such that each of the divided sheet materials SM' adjacent to each other in the width direction is wound up on the different winding shaft. Therefore, the take-up mechanism 30 is provided with two winding shafts 31*a* and 31*b*.

The two winding shafts 31*a* and 31*b* are disposed at the same height position (position in the vertical direction) and spaced apart in the front-rear direction with respect to the take-up mechanism 30. Each of the winding shafts 31*a* and 31*b* is rotatably supported by shaft portions formed at both ends thereof by the frame 5 (more specifically, a pair of side walls spaced apart from each other in the width direction of the frame 5) on the take-up side in the slitter device 1. The winding shaft 31*a* on the front side (side closer to the let-off mechanism 10) of the two winding shafts 31*a* and 31*b* corresponds to the divided sheet material SM' located at an even number in the width direction. The winding shaft 31*b* on the rear side corresponds to the divided sheet material SM' located at an odd number in the width direction.

In each of the winding shafts 31*a* and 31*b*, a take-up reel 33 for winding up the divided sheet material SM' corresponding to the winding shaft 31*a* and 31*b* is attached so as to be relatively non-rotatable. Each of the take-up reels 33 is disposed on the winding shafts 31*a* and 31*b* at the position in the width direction according to the divided sheet material SM' to be wound. Incidentally, in the example, the sheet material SM is divided into an odd number (5 pieces) of the divided sheet material SM' as illustrated. As a result, the number of the take-up reel 33 provided in the take-up mechanism 30 is an odd number (five). The take-up reels 33 of the odd number are divided into two winding shafts 31*a* and 31*b*. Accordingly, in the example, the number of the take-up reels 33 attached to each of the winding shafts 31*a* and 31*b* is different and the winding shaft 31*a* and the winding shaft 31*b* are rotationally driven so as to wind up the different number of the divided sheet material SM' in the same state.

The take-up mechanism 30 includes two take-up driving motors MT1 and MT2 which are the take-up driving motors for rotationally driving the winding shaft, and provided corresponding to each of the two winding shafts 31*a* and 31*b*. Each of the take-up driving motors MT1 and MT2 is connected to one end of the corresponding winding shafts 31*a* and 31*b*. Although the drawing is omitted, each of the take-up driving motors MT1 and MT2 is provided in a manner supported by, for example, the frame 5 on the take-up side. Similar to the let-off driving motor ML in the let-off mechanism 10, each of the take-up driving motors MT1 and MT2 is provided to direct the output shaft in the width direction (in the axis direction of the winding shafts 31*a* and 31*b*), and such that the position of the axis of the output shaft coincides with the position of the axis of the corresponding winding shafts 31*a* and 31*b*, when viewed in the width direction.

The take-up driving motor MT1 is connected to the corresponding winding shaft 31*a* via the coupling mechanism (not illustrated) and a powder clutch 34*a* for the tension control. More specifically, the output shaft of the take-up driving motor MT1 is connected to the input shaft of the powder clutch 34*a* by the coupling mechanism, and the output shaft of the powder clutch 34*a* is connected to the shaft portion on one end side of the winding shaft 31*a* by the coupling mechanism. Due to the configuration, the take-up driving motor MT1 can rotationally drive the winding shaft 31*a* (take-up reel 33 attached to that winding shaft 31*a*).

Similarly, the take-up driving motor MT2 is connected to the corresponding winding shaft 31*b* via the coupling mechanism (not illustrated) and a powder clutch 34*b* for tension control. More specifically, the output shaft of the take-up driving motor MT2 is connected to the input shaft of the powder clutch 34*b* by the coupling mechanism, and the output shaft of the powder clutch 34*b* is connected to the shaft portion on one end side of the winding shaft 31*b* by the coupling mechanism. Due to the configuration, the take-up driving motor MT2 can rotationally drive the winding shaft 31*b* (take-up reel 33 attached to that winding shaft 31*b*).

Accordingly, in the example, a take-up driving unit that that rotationally drives the winding shafts 31*a* and 31*b* is configured to include the take-up driving motors MT1 and MT2, the coupling mechanism, and the powder clutches 34*a* and 34*b*. Each of the winding shafts 31*a* and 31*b* is rotationally driven by the corresponding take-up driving motors MT1 and MT2, so that each of the divided sheet materials SM' is wound up on the corresponding take-up reel 33.

The take-up mechanism 30 includes a sensor for detecting the winding diameter (take-up side winding diameter sensor) for detecting the winding diameter of the divided sheet material SM' wound on the take-up reel 33. In the example, two of the take-up side winding diameter sensors are provided so as to detect the winding diameter of the divided sheet material SM' at one of the take-up reels 33 of the plurality of take-up reels 33 attached to each of the winding shafts 31*a* and 31*b* for each of the two winding shafts 31*a* and 31*b*. That is, the take-up mechanism 30 includes two take-up side winding diameter sensors 37*a* and 37*b* provided for each of the winding shafts 31*a* and 31*b*.

Regarding the winding diameter of the divided sheet material SM' wound on the take-up reel 33, the winding-up of the divided sheet material SM' by each take-up reel 33 is performed in substantially the same state at both the winding shafts 31*a* and 31*b*. Accordingly, the winding diameter of the divided sheet material SM' in each take-up reel 33 should be substantially the same as each other. Therefore, the take-up side winding diameter sensor 37 may be provided so as to detect the winding diameter of the divided sheet material SM' for at least one of the entire take-up reels 33. In the example, since the rotation driving of each of the winding shafts 31*a* and 31*b* is driven by the take-up driving motors MT1 and MT2 provided corresponding thereto, and the number of the take-up reels 33 attached to each of the winding shafts 31*a* and 31*b* is different, the take-up side winding diameter sensors 37*a* and 37*b* are provided for each of the winding shafts 31*a* and 31*b* in a manner of corresponding to each of the take-up driving motors MT1 and MT2.

Furthermore, the take-up mechanism 30 includes torque detecting devices 39*a* and 39*b* provided for each of the winding shafts 31*a* and 31*b* in order to detect the torque (shaft torque) applied to the winding shafts 31*a* a and 31*b* along with the rotation drive by the take-up driving motors MT1 and MT2. Since the torque detection devices 39*a* and 39*b* are well-known detection devices, a detailed drawing is omitted. The detection device adopted in the example is one example, and the torque detection devices 39*a* and 39*b* are the detection device of a type that detects the rotational force acting on the take-up driving motors MT1 and MT2 as the reaction force thereof as the take-up driving motors MT1 and MT2 impart torque to the corresponding winding shafts 31*a* and 31*b* by a load cell or the like.

Specifically, each of the torque detection devices 39*a* and 39*b* includes a support mechanism for the corresponding take-up driving motors MT1 and MT2. Each of the support mechanisms is disposed so that the take-up driving motors MT1 and MT2 can be rotated around the axis of the output shaft. Furthermore, each of the torque detection devices 39*a* and 39*b* includes a load detector based on the load cell. The load detector is supported at one end of the stationary portion such as the frame 5 of the take-up side as described above. In each of the torque detection devices 39*a* and 39*b*, the load detector is connected to the take-up driving motors MT1 and MT2 at the other end via a lever or the like fixed to the take-up driving motors MT1 and MT2. According to the torque detection devices 39*a* and 39*b* configured in this manner, the rotational force acting on the take-up driving motors MT1 and MT2 as the reaction force acts on the load detector (load cell) via the lever and is detected by the load cell. Based on the detected value by the load cell, the shaft torque is obtained.

In the slitter device 1 configured as described above, the operating states of the let-off driving motor ML, each of the take-up driving motors MT1 and MT2, and each of the powder clutches 34*a* and 34*b* are controlled by the drive control device 40. The winding diameter detection signals WS1 and WS2 output from the let-off side winding diameter sensor 17 and each of the take-up side winding diameter sensors 37*a* and 37*b*, and torque detection signals TS1 and TS2 output from each of the torque detection devices 39*a* and 39*b* are input to the drive control device 40.

Figure 4:
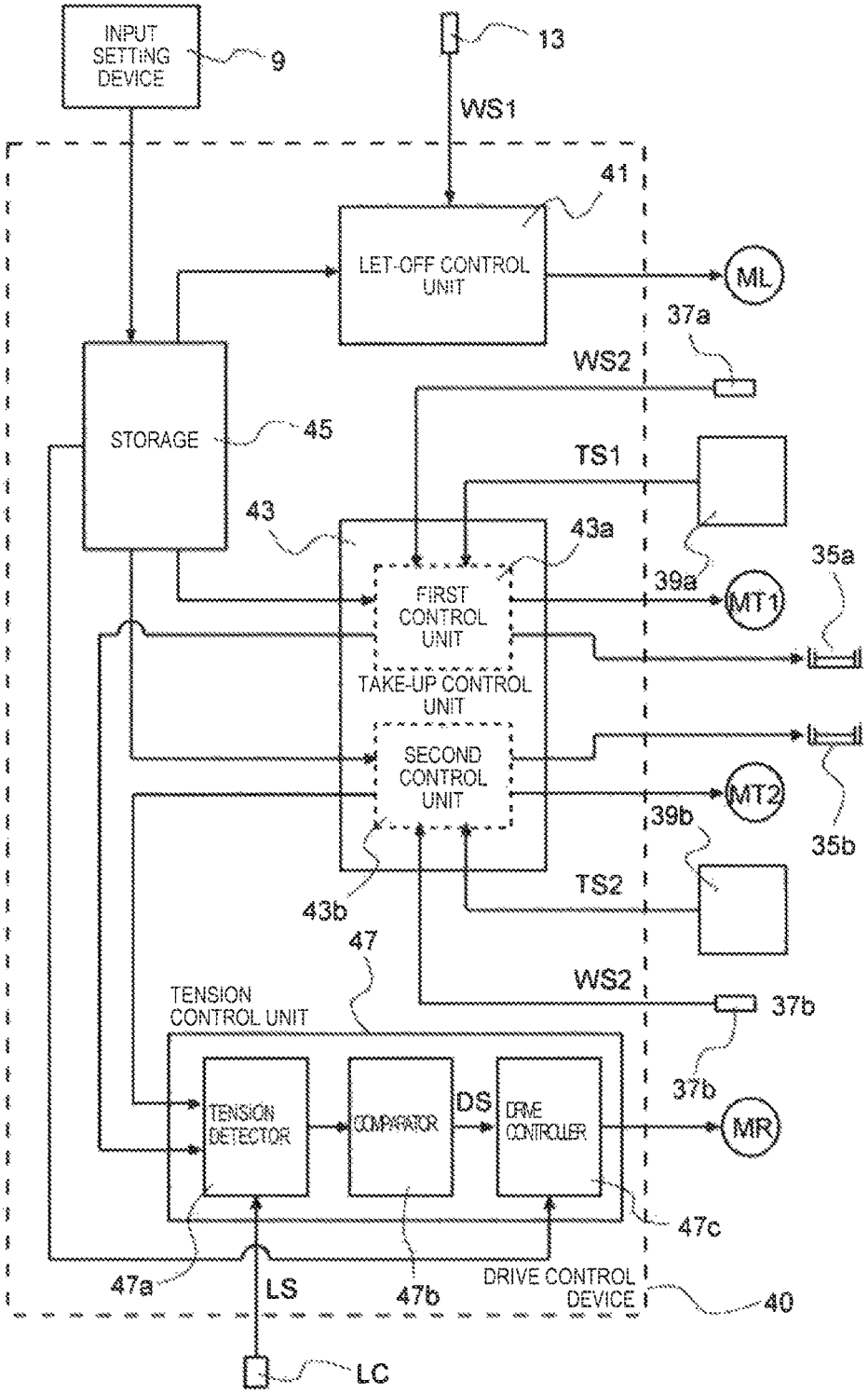
FIG. 4 is a block diagram for describing electrical control of each of the drive portions in the embodiment of the slitter device according to the invention.

As illustrated in FIG. 4, the drive control device 40 includes a let-off control unit 41 for controlling the operating state of the let-off driving unit 15 (let-off driving motor ML) in the let-off mechanism 10, and a take-up control unit 43 for controlling the operating state of the take-up driving unit (take-up driving motors MT1 and MT2, and powder clutches 34*a* and 34*b*) in the take-up mechanism 30.

As described above, in the example, the feeding-out of the sheet material SM from the raw-cloth roller RR is performed under the speed control. That is, the control of the operating state of the let-off driving motor ML by the let-off control unit 41 is performed as the speed control according to the set target speed (set speed). The winding-up of the divided sheet material SM' for each of the winding shafts 31*a* and 31*b* is performed under the tension control. That is, control of the operating state of the take-up driving unit (powder clutches 34*a* and 34*b*) by the take-up control unit 43 is performed as the tension control according to the set target tension (set tension). Therefore, the drive control device 40 includes a storage 45 which stores the set speed value which is the value of the set speed and the set tension value which is the value of the set tension. The let-off control unit 41 and the take-up control unit 43 are connected to the storage 45.

Incidentally, the storage 45 is connected to an input setting device 9 provided in the slitter device 1. The set speed value and the set tension value are input by the operator in the input setting device 9, and the input value is outputted from the input setting device 9 to the storage 45, so that the input value is stored in the storage 45.

The let-off side winding diameter sensor 17 for detecting the winding diameter of the sheet material SM in the raw-cloth roller RR is connected to the let-off control unit 41. Accordingly, the winding diameter detection signal WS1 output from the let-off side winding diameter sensor 17 is input to the let-off control unit 41 in the drive control device 40. The let-off control unit 41 has a function of obtaining the winding diameter of the sheet material SM in the raw-cloth roller RR based on the winding diameter detection signal WS1.

Although the detail of the let-off control unit 41 is omitted, the let-off control unit 41 drives the let-off driving motor ML and controls the operating state (driving speed) so that the feeding speed (transport speed) of the sheet material SM fed out from the raw-cloth roller RR coincides with the set speed, based on the set speed value read from the storage 45 and the winding diameter obtained from the winding diameter detection signal WS1.

Regarding the take-up control unit 43, as described above, in the example, the take-up mechanism 30 includes two winding shafts 31*a* and 31*b*, and is configured to be rotationally driven by the take-up driving motors MT1 and MT2 to which the winding shafts 31*a* and 31*b* are respectively connected. That is, the take-up driving unit is two take-up driving units corresponding to each of the winding shafts 31*a* and 31*b*, and is configured to include a first take-up driving unit 35*a* including the take-up driving motor MT1 and a second take-up driving unit 35*b* including the take-up driving motor MT2 (FIG. 2).

In the example, as described above, the number of the divided sheet material SM' wound on each of the winding shafts 31*a* and 31*b* is different. Therefore, in the example, the take-up control unit 43 includes a first control unit 43*a* for controlling the operating state of the first take-up driving unit 35*a* and a second control unit 43*b* for controlling the operating state of the second take-up driving unit 35*b*.

Specifically, the first and the second take-up driving units 35*a* and 35*b* include the powder clutches 34*a* and 34*b* as described above, and are configured such that the powder clutches 34*a* and 34*b* are interposed between the output shafts of the take-up driving motors MT1 and MT2 and the winding shafts 31*a* and 31*b*. The operating state of each of the powder clutches 34*a* and 34*b* is controlled so that the tension of each of the divided sheet materials SM' wound on the winding shafts 31*a* and 31*b* coincides with the tension to be target (target tension). The operating state (driving speed) of the take-up driving motors MT1 and MT2 connected to the input shafts of each of the powder clutches 34*a* and 34*b* at the output shaft is controlled according to the set rotational speed. As a result of the take-up driving motors MT1 and MT2 being controlled in this manner, torque according to the control state of the take-up driving motors MT1 and MT2 is applied to the input shafts of the powder clutches 34*a* and 34*b*.

In order to make the tension of each of the divided sheet materials SM' the same, it is necessary to set the shaft torque applied to the corresponding winding shafts 31*a* and 31*b* by the first and second take-up driving units 35*a* and 35*b* to a torque of magnitude corresponding to the number of the divided sheet material SM' wound on the winding shafts 31*a* and 31*b*. Accordingly, the operating state of the powder clutch 34*a* in the first take-up driving unit 35*a* and the powder clutch 34*b* in the second take-up driving unit 35*b* are controlled so that the shaft torque applied to the winding shaft 31*a* differs from the shaft torque applied to the winding shaft 31*b*. That is, the control of the operating state of both the powder clutches 34*a* and 34*b* is performed in different states.

Therefore, the take-up control unit 43 includes the first control unit 43*a* and the second control unit 43*b*, and is configured such that the first control unit 43*a* controls the operating state of the take-up driving motor MT1 and the powder clutch 34*a*, and the second control unit 43*b* controls the operating state of the take-up driving motor MT2 and the powder clutch 34*b*. As a result, the set tension value set in the storage 45 differs between the value for the winding shaft 31*a* and the value for the winding shaft 31*b*.

Regarding the set tension value, specifically, each of the powder clutches 34*a* and 34*b* is controlled in the operating state thereof according to the set tension value set for the corresponding winding shafts 31*a* and 31*b*, and transmits the shaft torque corresponding to the operating state to the corresponding winding shafts 31*a* and 31*b*. The shaft torque acting on each of the winding shafts 31*a* and 31*b* is set to a torque of magnitude corresponding to the number of the divided sheet material SM' wound on the winding shafts 31*a* and 31*b* as described above. Therefore, the set tension value which is the basis of the control for generating such shaft torque is set to different values between the winding shaft 31*a* and the winding shaft 31*b* which are different in the number of the divided sheet material SM' wound.

Specifically, the set tension value for each of the winding shafts 31*a* and 31*b* set in the storage 45 is the sum of the target tension (target tension×the number of the divided sheet material SM') of each of the divided sheet material SM' wound on the winding shafts 31*a* and 31*b*, that is, the target tension (total tension) of the entire divided sheet material SM' in each of the winding shafts 31*a* and 31*b*.

The first and the second control units 43*a* and 43*b* in the take-up control unit 43 are connected to the storage 45. The first and second control units 43*a* and 43*b* are configured to read the set tension values set for each of the winding shafts 31*a* and 31*b* from the storage 45.

The take-up side winding diameter sensor 37*a* and the torque detection device 39*a* provided for the winding shaft 31*a* are connected to the first control unit 43*a*. Accordingly, the winding diameter detection signal WS2 output from the take-up side winding diameter sensor 37*a* and the torque detection signal TS1 output from the torque detection device 39*a* are input to the first control unit 43*a*. Similarly, the take-up side winding diameter sensor 37*b* and the torque detection device 39*b* provided for the winding shaft 31*b* are connected to the second control unit 43*b*. Accordingly, the winding diameter detection signal WS2 output from the take-up side winding diameter sensor 37*b* and the torque detection signal TS2 output from the torque detection device 39*b* are input to the second control unit 43*b*.

The first control unit 43*a* and the second control unit 43*b* has a function of obtaining the actual total tension of the divided sheet material SM' in the corresponding winding shafts 31*a* and 31*b*. Incidentally, when the actual total tension is F, the shaft torque that the take-up driving motor applies to the winding shaft is T, and the winding diameter (diameter) of the divided sheet material SM' is D, the total tension F can be obtained by $F=T/(D/2)=2T/D$.

Therefore, the first and second control units 43*a* and 43*b* have a function of obtaining the winding diameter of the divided sheet material SM' based on the winding diameter detection signals WS1, WS2 from the take-up side winding diameter sensors 37*a* and 37*b* connected thereto, and a function of obtaining the shaft torque applied to the winding shafts 31*a* and 31*b* based on the torque detection signals TS1 and TS2 from the torque detection devices 39*a* and 39*b* (load cell described above). The first and second control units 43*a* and 43*b* have a function of obtaining the actual total tension value described above (actual total tension value) of the divided sheet material SM' in the corresponding winding shafts 31*a* and 31*b* from the obtained winding diameter and the shaft torque.

In the storage 45, the rotational speed is set as the set winding speed to control the take-up driving motors MT1 and MT2 as described above. The first and second control units 43*a* and 43*b* are configured to read the set winding speed from the storage 45, to drive the take-up driving motors MT1 and MT2, and to control the operating state according to the set winding speed.

Furthermore, the first and second control units 43*a* and 43*b* are configured to compare the actual total tension value in the winding shafts 31*a* and 31*b* obtained as described above with the set tension value which is the value of the total tension of the target set for each of the winding shafts 31*a* and 31*b*, and to control the operating state of the powder clutches 34*a* and 34*b*, specifically, the exciting current for the exciting coil in the powder clutches 34*a* and 34*b*, based on the comparison result.

The torque transmitted by the powder clutches 34*a* and 34*b* is proportional to the magnitude of the exciting current. The shaft torque applied to the winding shafts 31*a* and 31*b* is a torque of magnitude corresponding to the transmitted torque. The total tension of the divided sheet material SM' and the tension of each of the divided sheet materials SM' in each of the winding shafts 31*a* and 31*b* are the tensions corresponding to the shaft torque. Therefore, the first and the second control units 43*a* and 43*b* control the magnitude of the exciting current for the powder clutches 34*a* and 34*b* so that the actual total tension value coincides with the set tension value. As a result, each of the divided sheet materials SM' is wound on the corresponding winding shafts 31*a* and 31*b* in a state where the tension substantially coincides with the target tension.

In the slitter device 1 as described above, the support roll 21 in the cutter device 20 is provided so as to guide the sheet material SM (divided sheet material SM') toward the take-up mechanism 30 side as described above. The support roll 21 is rotatably supported on a shaft portions formed at both ends of the frame 5 of the take-up side via bearings or the like.

The support roll 21 is connected to a roll driving motor MR at the shaft portion on one end side, and provided so as to be rotationally driven by the roll driving motor MR. That is, the slitter device 1 is provided with the roll driving motor MR for rotationally driving the support roll 21 in the cutter device 20, and is configured such that the roll driving motor MR thereof rotationally drives the support roll 21.

Accordingly, in the slitter device 1, although the let-off mechanism 10 feeds out the sheet material SM and the take-up mechanism 30 winds up (tows) the sheet material SM (divided sheet material SM'), so that the sheet material SM is transported, the support roll 21 in the cutter device 20 is rotationally driven, so that the transport of the sheet material SM is assisted. That is, in the slitter device 1, the support roll 21 in the cutter device 20 is configured to contribute to the transport of the sheet material SM.

Although the drawing is omitted, the roll driving motor MR is provided, for example, in a manner supported on the frame 5 on the take-up side. The roll driving motor MR is provided in an arrangement such that the output shaft is oriented in the width direction and the position of the axis of the output shaft coincides with the position of the axis of the support roll 21 when viewed in the width direction, similar to the let-off driving motor ML and the take-up driving motors MT1 and MT2. The output shaft of the roll driving motor MR is connected to the shaft portion on one end side of the support roll 21 via the coupling mechanism (not illustrated). As a result, the roll driving motor MR can rotationally drive the support roll 21.

The slitter device 1 has a configuration for obtaining the tension value of the sheet material SM fed out from the let-off mechanism 10, that is, a raw-cloth tension value referred to in the invention. Specifically the configuration for obtaining the raw-cloth tension value is as follows.

The slitter device 1 is provided with the guide roll 3 supported by the frame 7 (a pair of brackets 7*b* and 7*b*) on the let-off side as described above. Regarding the support of the guide roll 3, a swing lever 7*d* is supported on each of the brackets 7*b* of the frame 7 via a shaft member 7*e*. Each of the swing levers 7*d* is supported by the shaft member 7*e* via a bearing or the like in the vicinity of the intermediate portion, and is swingably attached to the bracket 7*b*. The guide roll 3 is supported by the brackets 7*b* and 7*b* via the pair of the swing levers 7*d* and 7*d* in a manner that each of the shaft portions formed at both ends is fitted and inserted into one end portion of the swing lever 7*d* via the bearing or the like. Accordingly, the guide roll 3 is rotatable and is in a state capable of swinging displacement about the shaft member 7*e* with respect to the brackets 7*b* and 7*b*.

A load detector 8 based on a load cell LC is connected to the other end of each of the swing levers 7*d*. However, each of the load detectors 8 is supported by the bracket 7*b* at one end thereof and is connected to the swing lever 7*d* at the other end thereof. According to the configuration, as described above, the guide roll 3 provided in a state capable of swinging displacement is in a state where the swing is supported by the load detectors 8 and 8 via the swing levers 7*d* and 7*d* (state where the swing displacement is prevented). Accordingly, according to the configuration, the load exerted by the sheet material SM by the tension on the guide roll 3 around which the sheet material SM is wound acts on the load detector 8 via the swing lever, and is detected by the load cell LC. The load cell LC outputs a load signal LS, which is a signal corresponding to the detected value of the load, to the drive control device 40.

In addition to the configuration described above, the drive control device 40 includes a tension control unit 47 which drives the roll driving motor MR and controls the operating state. The tension control unit 47 includes a tension detector 47*a* for obtaining the raw-cloth tension value based on the load signal LS from the load cell LC. That is, the tension detector 47*a* has a function of calculating the raw-cloth tension value by calculation for each of the predetermined control periods based on the input load signal LS from the load cell LC.

Accordingly, the load cell LC is connected to the tension detector 47*a* of the tension control unit 47 in the drive control device 40. The load signal LS which is the output signal thereof is input to the tension detector 47*a*. The raw-cloth tension value obtained in the tension detector 47*a* is obtained from the load exerted on the guide roll 3 by the tension in the entire portion where the sheet material SM is wound on the guide roll 3 as described above. Accordingly, the required raw-cloth tension value represents the total tension over the width direction of the sheet material SM.

In this manner, in the example, the load detectors 8 and 8 which include the guide roll 3, the swing levers 7*d* and 7*d*, and the load cell LC as the device configuration are involved in obtaining the raw-cloth tension value, and the raw-cloth tension value is obtained by the tension detector 47*a* of the tension control unit 47 in the drive control device 40. Accordingly, the combination of the device configuration and the tension detector 47*a* corresponds to a first tension detecting unit referred to in the invention. In this manner, in the slitter device 1 of the example, the guide roll 3 provided to guide the sheet material SM fed out from the let-off mechanism 10 toward the cutter device 20 side is used as a portion of the first tension detecting unit.

The first control unit 43*a* and the second control unit 43*b* in the take-up control unit 43 are connected to the tension detector 47*a*. The actual total tension value (more accurately, signal corresponding to the actual total tension value) for each of the winding shafts 31*a* and 31*b* obtained in each of the first control unit 43*a* and the second control unit 43*b* as described above is input to the tension detector 47*a*. The tension detector 47*a* has a function of obtaining the sum of the tension values of each of the divided sheet materials SM', that is, the divided material tension value referred to in the invention from the input actual total tension value for each of the winding shafts 31*a* and 31*b*. The divided material tension value is obtained by adding the actual total tension value for each of the winding shafts 31*a* and 31*b* for each of the control periods.

Accordingly, in the example, a combination of the take-up side winding diameter sensors 37*a* and 37*b*, the torque detection devices 39*a* and 39*b*, and the take-up control units 43 (first control unit 43*a* and second control unit 43*b*), and the tension detector 47*a* in the tension control unit 47, which are the configuration for obtaining the actual total tension value for each of the winding shafts 31*a* and 31*b*, corresponds to the second tension detecting unit referred to in the invention. In this manner, in the example, the tension detector 47*a* is shared by the first tension detecting unit and the second tension detecting unit.

In addition to the tension detector 47*a*, the tension control unit 47 includes a comparator 47*b* and a drive controller 47*c*, and these are configured to be connected in cascade in the order of the tension detector 47*a*, the comparator 47*b*, and the drive controller 47*c*. The tension detector 47*a* outputs the raw-cloth tension value and the divided material tension value (more accurately, signal corresponding to each tension value) obtained as described above to the comparator 47*b*, respectively.

The comparator 47*b* has a function of comparing both tension values when the raw-cloth tension value and the divided material tension value are output from the tension detector 47*a*, and obtaining a deviation (including 0) of the raw-cloth tension value with respect to the divided material tension value, based on the tension of the divided sheet material SM' whose tension is controlled by the take-up mechanism 30 as described above. The comparator 47*b* is configured to output a deviation signal DS corresponding to the obtained deviation to the drive controller 47*c* at the obtained time point.

The drive controller 47*c* is connected to the storage 45. In the storage 45, a basic speed (rotational speed) for controlling the operating state of the roll driving motor MR is set. The drive controller 47*c* is configured to generate a speed command value such that the support roll 21 is rotationally driven at the rotational speed according to the set basic speed, and to control (speed control) the operating state of the roll driving motor MR according to the speed command value.

The drive controller 47*c* has a function of correcting the speed command value based on the deviation signal DS from the comparator 47*b*. As a result, in a case where the raw-cloth tension value and the divided material tension value coincide with each other, that is, in a case where the tension of the sheet material SM located upstream side (let-off mechanism 10 side) of the support roll 21 and the sum of the tension of each of the divided sheet material SM' located on the downstream side (take-up mechanism 30 side) of the support roll 21 coincide with each other, the roll driving motor MR is speed-controlled according to the speed command value corresponding to the basic speed. On the other hand, in a case where the tension of the divided sheet material SM and the sum of the tension of each of the divided sheet materials SM' do not coincide with each other, that is, in a case where there is a deviation between both cases, the roll driving motor MR is speed-controlled according to the speed command value corrected based on the deviation.

The operation of the slitter device 1 of the example configured as described above is as follows.

First, each of the divided sheet material SM' which is the sheet material SM on the downstream side is set in a state where the tension thereof coincides with the target tension by the take-up mechanism 30. On the other hand, in the let-off mechanism 10, the sheet material SM on the upstream side is fed out from the raw-cloth roller RR such that the feeding speed coincides with the set speed, that is, in a state where only the feeding speed is managed. Therefore, despite being towed under the tension control on the take-up mechanism 30 side, the tension of the sheet material SM on the upstream side may be lower than the tension of the sheet material SM on the downstream side (entire divided sheet material SM') in some cases. In such a state, cutting of the sheet material SM by the cutter device 20 is not appropriately performed, and problems such as cutting defect may occur in some cases.

As described above, the support roll 21 in the cutter device 20 existing in the transport path of the sheet material SM is positively rotationally driven by the roll driving motor MR, and contributes to the transport of the sheet material SM. However, if the rotation drive of the support roll 21 (control of the operating state of the roll driving motor MR) is performed by the speed control so as to synchronize with the feeding speed of the sheet material SM merely by the let-off mechanism 10 as in the related art, without considering the actual tension of the sheet material SM, it is impossible to sufficiently cope with the reduction of the tension of the sheet material SM and the above problems caused thereby as described above.

On the other hand, according to the slitter device 1 according to the example based on the invention, the control of the operating state of the roll driving motor MR for rotationally driving the support roll 21 refers to the actual tension of the sheet material SM, and is performed in an aspect that the detection value of the tension of the sheet material SM on the upstream side coincides with the tension value of the entire divided sheet material SM' (the sum of the tension values of each of the divided sheet materials SM') on the downstream side whose tension is controlled. That is, the support roll 21 which contributes to the transport of the sheet material SM is rotationally driven at such a speed that the tension of the sheet material SM on the upstream side coincides with the sum of the target tensions of each of the divided sheet materials SM' (the sum of the set tension values for each of the winding shafts 31*a* and 31*b*). As a result the tension of the sheet material SM on the upstream side is maintain at a desired degree, and furthermore, the tension control by the take-up mechanism 30 and the tension of the entire sheet material SM including the divided sheet material SM' is maintained at a desired level. As a result, in the slitter device 1, cutting of the sheet material SM by the cutter device 20 is appropriately performed (cutting defect is effectively prevented), and quality deterioration of the sheet material SM (divided sheet material SM') is effectively prevented.

Hereinbefore, although one embodiment (hereinafter, referred to as the "example") of the slitter device according to the invention is described, the invention is not limited to the above-described example, and it is possible to implement the invention with other embodiments (modification examples) as described below.

1. Regarding the configuration for the tension control, in the above example, the configuration includes the powder clutches 35*a* and 35*b*, and the drive control device 40 (take-up control unit 43) is configured to control the operating state of the powder clutches 35*a* and 35*b*, to control the shaft torque applied to the winding shafts 31*a* and 31*b* by controlling the transmission torque with respect to the torque generated by the take-up driving motors MT1 and MT2. That is, the configuration for tension control includes the powder clutch that transmits the output torque of the driving motor to the shaft to be driven, and is configured to control the transmission torque by the powder clutch. In the slitter device 1 of the example, the configuration for the tension control is adopted for the take-up mechanism 30 (take-up driving units 35*a* and 35*b*).

However, in the invention, the configuration for the tension control is not limited to the configuration using the powder clutch as described above, and other known configuration, for example, the configuration in which the torque generated by the driving motor itself is controlled by torque control or speed control by the drive control device may be adopted. In that case, the configuration for the tension control is such that the powder clutch is omitted and the driving motor (take-up driving motors MT1 and MT2 in the above example) is connected to the shaft to be driven (winding shafts 31*a* and 31*b* in the above example) by the coupling mechanism in the output shaft.

The invention is not limited to the slitter device in which the configuration for the tension control not limited to the configuration of the above example is adopted in the take-up mechanism as in the above example, and can be applied to a slitter device in which the configuration for tension control is adopted in the let-off mechanism. In other words, the slitter device on which the invention is based is not limited to a slitter device in which the feeding-out of the sheet material SM from the raw-cloth roller RR is performed by the speed control as in the example, and the winding-up of the divided sheet material SM' on the winding shaft is performed by the tension control, and may be a slitter device in which the feeding-out of the sheet material SM from the raw-cloth roller RR is performed by the tension control, and the winding-up of the divided sheet material SM' on the winding shaft is performed by the speed control.

Specifically, in the slitter device, the control of the let-off mechanism (let-off driving unit) is performed so that the tension of the sheet material SM fed from the raw-cloth roller RR coincides with the set target tension. Accordingly, the control of the let-off mechanism is performed, for example, based on the tension of the sheet material SM detected by the first tension detecting unit (guide roll 3, load cell LC, and the like) of the above example, and the set tension value set in the storage in the drive control device. The control of the take-up mechanism (take-up driving unit) is performed so that the movement speed (transport speed) of the divided sheet material SM' before being wound up on the winding shaft (take-up reel) coincides with the set target speed. Accordingly, the control of the take-up mechanism is performed based on the set speed value set on the storage in the drive control device and the winding diameter of the divided sheet material SM' detected by the take-up side winding diameter sensor in the above example, for example.

In that case, the control for rotationally driving the support roll (driving the roll driving motor) in the cutter device is performed so as to coincide the divided material tension value which is the sum of the tension values of the divided sheet material SM' on the downstream side with the raw-cloth tension value which is the tension of the sheet material SM on the upstream side from the support roll.

In a case where the feeding-out of the sheet material SM from the raw-cloth roller RR is performed by the tension control, the configuration of the let-off driving unit is not limited to the configuration described in the above example, and may be a configuration using the powder clutch similar to the take-up driving unit in the above example. In a case where the winding-up of the divided sheet material SM' is performed by the speed control, the take-up driving unit may be configured to connect the winding shaft and the take-up driving motor via the driving-force transmission mechanism such as a gear train or the like.

2. Regarding the configuration for obtaining the tension in the drive control device, in the above example, the load detector 8 is provided to detect the tension of the sheet material SM, and the load signal LS output from the load cell LC in the load detector 8 is input to the tension detector 47*a* in the tension control unit 47. The tension of the sheet material SM is obtained in the tension detector 47*a*. However, the drive control device may be configured such that the load signal LS is input to the let-off control unit and the let-off control unit has a function to obtain tension. In that case, the tension (more accurately, signal corresponding to the tension value) of the sheet material SM obtained in the let-off control unit is output toward the comparator in the tension control unit. Incidentally, in a case where the feeding-out side is subjected to the tension control as described above, according to the example, the let-off control unit is configured to have the function of obtaining the tension of the sheet material SM in this manner.

In the above example, the drive control device is configured such that the actual total tension values for each of the winding shafts 31*a* and 31*b* are obtained in the take-up control unit 43 (first control unit 43*a* and second control unit 43*b*), and the divided material tension value is obtained in the tension detector 47*a* in the tension control unit 47 from both the actual total tension values. That is, regarding the tension, the take-up control unit is configured to obtain only the actual total tension value for each of the winding shafts 31*a* and 31*b* used for the tension control. However, in the drive control device, in addition to the actual total tension value for each of the winding shafts 31*a* and 31*b*, the take-up control unit may be configured to have a function of obtaining the divided material tension value from both the obtained actual total tension values. In that case, the obtained divided material tension value is output to the comparator in the tension control unit. Accordingly, in that case, as described above, in a case where the let-off control unit has the function of obtaining the tension of the sheet material SM (raw-cloth tension value), the tension detector 47*a* of the tension control unit 47 in the above example is omitted.

In a case where the winding-up side is subjected to the speed control as described above, the drive control device may be configured such that the actual total tension value for each of the winding shafts 31*a* and 31*b* is obtained in the take-up control unit similar to the above example, and may be configured to be obtained by the tension detector included in the tension control unit in accordance with the example in which the feeding-out side is subjected to the speed control.

The tension detector 47*a* in the above example may be a tension detecting unit independent from the tension control unit 47 for controlling the driving of the roll driving motor MR. The drive control device may be configured so that the actual total tension value for each of the winding shafts 31*a* and 31*b* obtained by the take-up control unit in the above example is obtained by the tension detecting unit (tension detecting unit has a function of obtaining the actual total tension value for each of the winding shafts 31*a* and 31*b*). In that case, the detector (torque detecting units 39*a* and 39*b* and winding diameter sensors 37*a* and 37*b*) for obtaining the actual total tension value is connected to the tension detecting unit. In a case where the winding-up side is subjected to the tension control as in the above example, the actual total tension value for each of the winding shafts 31*a* and 31*b* obtained by the tension detecting unit is output to the first control unit and the second control unit in the take-up control unit.

3. Regarding the second tension detecting unit, in the above example, the actual total tension value which is the basis of the divided material tension value is obtained from the shaft torque applied to the winding shafts 31*a* and 31*b* in the take-up mechanism, and the winding diameter of the wound divided sheet material SM'. That is, the second tension detecting unit is configured to include the torque detecting units 39*a* and 39*b* and the winding diameter sensors 37*a* and 37*b*. However, the slitter device according to the invention may be configured such that the actual total tension value is directly detected in the take-up mechanism.

Specifically, in the take-up mechanism, the roll for tension detection (tension detection roll) provided corresponding to each of the winding shafts is provided between the cutter device (support roll) and the winding shaft (take-up reel). However, the tension detection roll is provided so as to extend over the existence range of the divided sheet material SM' in the width direction, and to wind up around the divided sheet material SM' wound on the corresponding winding shafts. Furthermore, similar to the guide roll 3 in the first tension detecting unit in the above example, the tension detection roll is supported on the frame 5 on the take-up side via the swing lever, and the load detector for detecting the load exerted by the divided sheet material SM' on the tension detection roll by the tension is connected to the tension detection roll. The second tension detecting unit may include the tension detection roll and the load detector, and the actual total tension value may be obtained based on the detection value by the load detector.

The first tension detecting unit is not limited to the configuration of the example which detects the tension of the sheet material SM using the guide roll 3 which guides the sheet material SM towards the cutter device. For example, the roll for tension detection (tension detection roll) on which the sheet material SM is wound is provided between the guide roll 3 and the let-off mechanism (raw-cloth roller), and the first tension detecting unit may be configured so as to detect the tension of the sheet material SM using the tension detection roll. However, in the case of such a configuration, the tension detection roll is supported by the frame 7 on the let-off side via the swing lever as the guide roll 3 of the above example, and the load detector is connected to the tension detection roll. The guide roll 3 is directly supported against the frame 7 (brackets 7*b* and 7*b*) on the let-offside.

4. Regarding the driving of the support roll in the cutter device, in the above example, the control of the operating state of the roll driving motor MR that rotationally drives the support roll 21 is a speed control that controls the rotational speed of the support roll 21. However, in the slitter device of the invention, the control of the operating state of the roll driving motor that rotationally drives the support roll is not limited to the speed control as described above, and may be a torque control that controls the torque applied to the support roll. In that case, the set torque for the reference determined according to the set tension value or the like is set in the storage in the drive control device, and basically, the operating state of the roll driving motor is controlled according to the set torque. In a case where a deviation occurs between the divided material tension value and the raw-cloth tension value, for example, the drive control device (tension control unit) may be configured so that correcting the set torque of the reference on the basis of the deviation is performed in the tension control unit of the drive control device, and the tension control unit controls the operating state of the roll driving motor according to the torque value obtained by correcting the set torque.

5. Regarding the take-up mechanism, in the above example, the slitter device 1 is configured such that the take-up mechanism 30 is provided with two winding shafts 31*a* and 31*b*, and a plurality of the divided sheet materials SM' formed by being divided by the cutter device 20 are wound on one of winding shafts 31*a* and 31*b* to be distributed to the two winding shafts 31*a* and 31*b*. However, the slitter device according to the invention may be configured so that only one winding shaft is provided in the take-up mechanism, and the divided sheet material SM' is wound up on one winding shaft (entire divided sheet material SM' is wound up on one winding shaft). In the case of such a configuration, the actual total tension value for each of the winding shafts described above is the divided material tension value referred to in the invention.

The invention is not limited to any of the embodiments described above, and various modifications can be made without departing from the spirit of the invention.

What is claimed is:

1. A slitter device comprising:

a let-off mechanism having a let-off driving unit on which a raw-cloth roller formed by winding up an elongated sheet material in a roll shape is mounted, and which has a let-off driving motor as a driving source for rotationally driving the raw-cloth roller;

a cutter device for dividing the sheet material fed out from the let-off mechanism in a width direction of the sheet material to form a plurality of divided sheet materials, having a plurality of disk-shaped rotary blades provided according to the number of divisions of the sheet material, and having a support roll to which the rotary blade is pressed and around which the sheet material is wound;

a take-up mechanism having a winding shaft on which a plurality of take-up reels for winding up each of the divided sheet materials are supported, and having a take-up driving unit which has a take-up driving motor as a driving source for rotationally driving the winding shaft;

a drive control device or control device for controlling the driving of the let-off driving unit and the take-up driving unit, which performs the drive control of one of the let-off driving unit and the take-up driving unit as a tension control and performs the drive control of the other as a speed control;

a roll driving motor that is connected to the support roll to rotationally drive the support roll;

a first tension detecting unit for obtaining a raw-cloth tension value which is a tension value of the sheet material fed out from the let-off mechanism; and a second tension detecting unit for obtaining the divided material tension value which is the sum of the tension values of each of the divided sheet materials, wherein the drive control device includes a comparator to which the first tension detecting unit and the second tension detecting unit are connected, and which compares the raw-cloth tension value and the divided material tension value with each other, and a drive controller which controls an operating state of the roll driving motor such that the raw-cloth tension value and the divided material tension value coincide or substantially coincide with each other based on the comparison result of the comparator.

* * * * *